United States Patent [19]

List, deceased

[11] Patent Number: 4,950,081

[45] Date of Patent: Aug. 21, 1990

[54] MULTI-SPINDLE KNEADING MIXER

[75] Inventor: Heinz List, deceased, late of Pratteln, Switzerland, by Jorg List, executor

[73] Assignee: List AG, Pratteln, Switzerland

[21] Appl. No.: 311,691

[22] Filed: Feb. 15, 1989

[30] Foreign Application Priority Data

Feb. 16, 1988 [CH] Switzerland ..... 00551/88

[51] Int. Cl.[5] ..... B01F 7/08

[52] U.S. Cl. ..... 366/85; 366/90; 366/299; 366/301; 366/310; 366/313

[58] Field of Search ..... 366/81, 85, 90, 291, 366/298, 299, 300, 301, 310, 313, 319, 315, 312

[56] References Cited

U.S. PATENT DOCUMENTS

| | | | |
|---|---|---|---|
| 2,750,163 | 6/1956 | Loedige et al. | 366/313 |
| 3,506,066 | 4/1970 | Nonnenmacher | 366/298 X |
| 3,687,422 | 8/1972 | List | 366/299 X |
| 3,689,035 | 9/1972 | List | 366/85 X |
| 4,650,338 | 3/1987 | List et al. | 366/85 |
| 4,733,607 | 3/1988 | Star et al. | 366/81 X |
| 4,752,139 | 6/1988 | Hauck | 366/298 |
| 4,775,239 | 10/1988 | Martinek et al. | 366/301 X |

*Primary Examiner*—Frankie L. Stinson

*Attorney, Agent, or Firm*—Bachman & LaPointe

[57] ABSTRACT

The invention relates to a multi-spindle kneading mixer with at least two axis-parallel agitator shafts engaging into one another, one of which is designed as a disk shaft, into which kneading elements of a kneading shaft engage, wherein these kneading elements scrape the product off from the disk surfaces and press it by means of corresponding diverting surfaces into a kneading gap formed on the one hand by the kneading element and on the other hand by the opposite disk surface, the product being moved axially to and from between the disk surfaces.

8 Claims, 4 Drawing Sheets

MULTI-SPINDLE KNEADING MIXER

The invention relates to a kneading mixer for performing mechanical, chemical and thermal processes, with at least two axis-parallel rotating shafts, disk elements with approximately axially aligned kneading bars fastened to them being arranged on one shaft and kneading elements being arranged on the other shaft, and the disk elements and kneading elements engaging into one another.

A multi-spindle mixing and kneading machine is known from Swiss Patent Specification No. 506,322, one shaft of this being equipped with radial disk elements and axially aligned kneading bars which are arranged between the disks (disk shaft) and into which engage frame-like kneading elements arranged on a second parallel agitator shaft (kneading shaft) and cleaning the disks and kneading bars of the disk shaft. The shearing forces and mixing movements exerted on the processed product by these kneading elements on the kneading shaft, in interaction with the disks and kneading bars of the disk shaft, have proved highly effective for a macro-mixing effect, but are often insufficient or very time-consuming for the micro-kneading effect which, in many products, is necessary for breaking down the agglomerates.

The present invention affords a significant improvement of the micro-kneading effect and consequently a substantial broadening of the scope of use.

The invention is illustrated in the accompanying drawings wherein.

Figure 1:
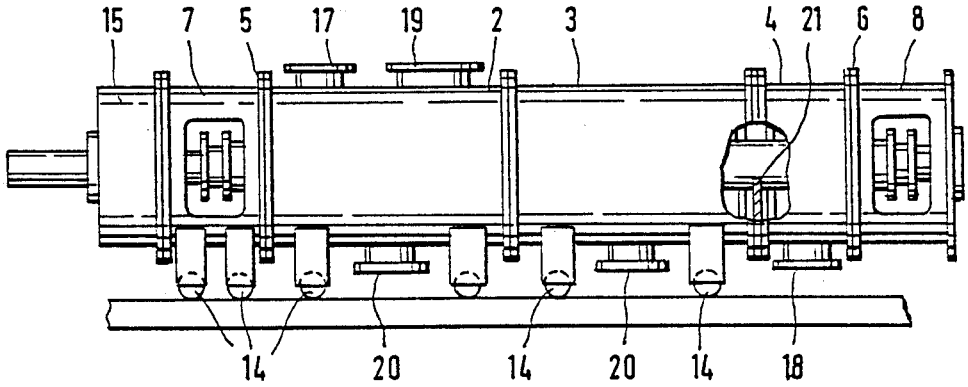
FIG. 1 shows a side view of the kneading mixer.
Figure 2:
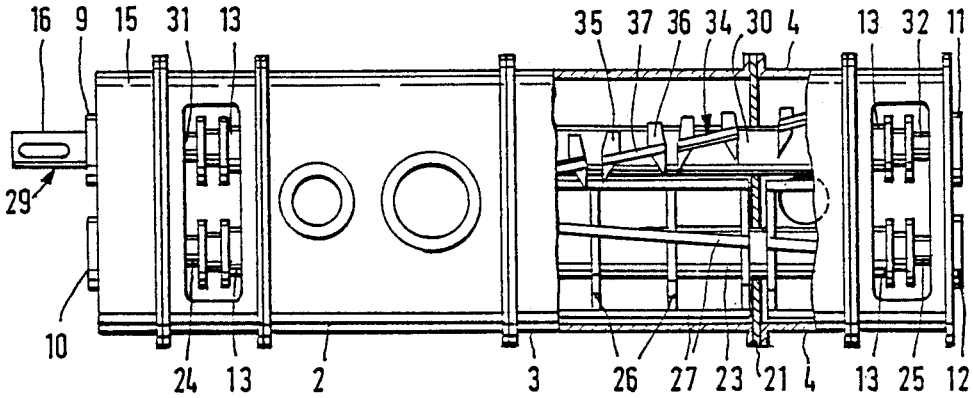
FIG. 2 shows a top view of the kneading mixer, with the housing partially cut away.

The construction of the kneading mixer is illustrated in FIGS. 1 and 2, portions being shown with a cutaway housing for a clearer representation of the agitators.

Figure 7:
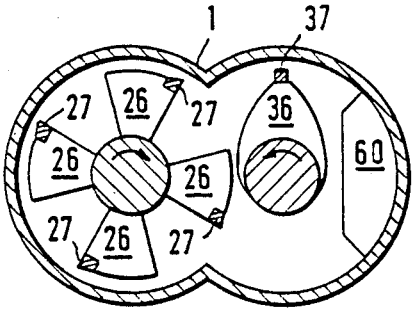
FIG. 7 shows a cross-section along the line III—III of FIG. 4.
Figure 6:
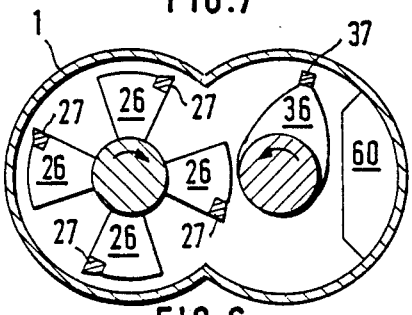
FIG. 6 shows a cross-section along the line II—II of FIG. 4.
Figure 5:
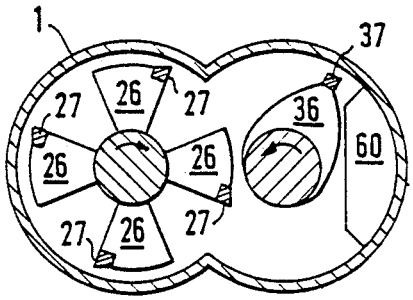
FIG. 5 shows a cross-section along the line I—I of FIG. 4.
Figure 4:
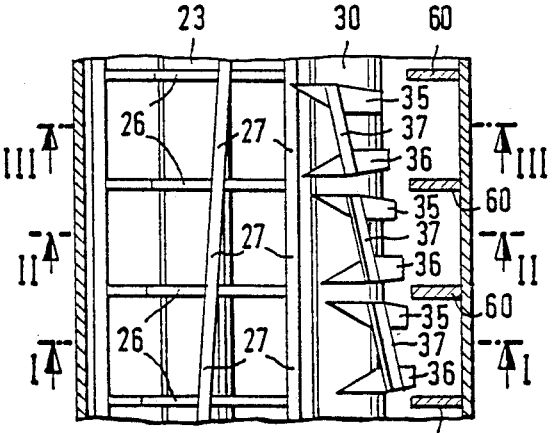
FIG. 4 shows a top view of an agitator portion, with the housing open at the top.
Figure 8:
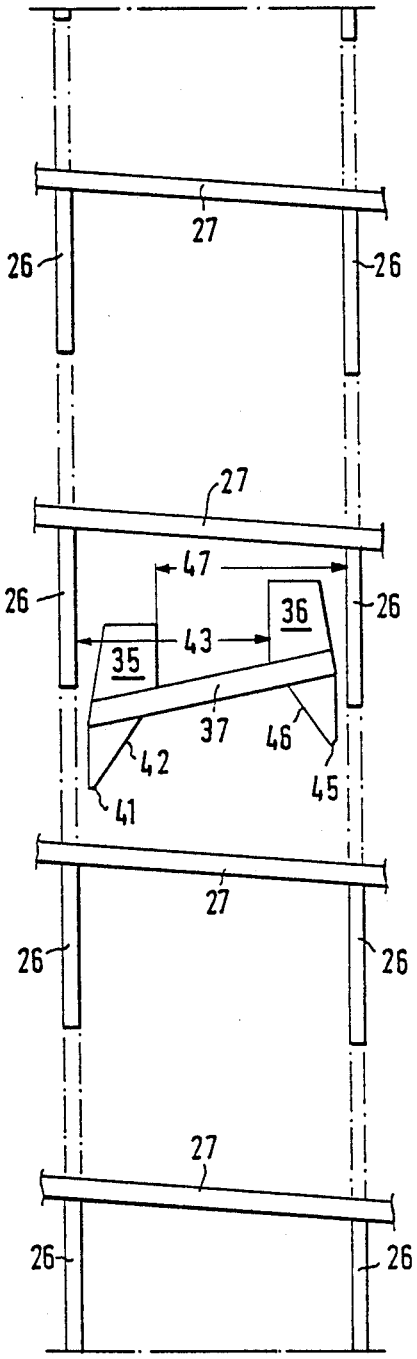
FIG. 8 shows a developed diagram to illustrate the functioning of the kneading elements with a radial kneading gap in a frame-like design.

In conformity with the two agitator shafts engaging into one another, the housing has the cross-sectional form of a FIG. 8, as is evident from FIGS. 5 to 7. The housing is composed of the housing parts 2 and 3 and the outflow housing 4 which are screwed together by means of flanges. On each of its end faces, it is closed off by means of the end walls 5 and 6 which adjoin the louvers 7 and 8 with the agitator-shaft bearings 9, 10 and 11, 12. The passage of the agitator-shaft journals through the end walls is equipped with glands 13 of a known type. The kneading mixer is supported by means of the feet 14. 15 denotes a gear which couples the two shafts 22 and 29 to one another in the desired speed ratio. The drive-shaft journal 16 can itself be driven in any way from a gear and a drive unit. 17 denotes the feed connection for the product which leaves the machine at the outflow connection 18. 19 denotes a connection for drawing off gases and vapors, while 20 designates the various connections for emptying the machine.

For a clear illustration of the working principle, all the Figures and the description show a version in which the driven kneading shaft of higher speed rotates four times faster than the disk shaft driven via the gear 15. Of course, it is also easily possible to provide other expedient ratios between the two shafts.

The first shaft or disk shaft 22 comprises a central tube 23 with laterally attached shaft journals 24 and 25 which are supported in the bearings 10 and 12. The central tube 23 carries, in radial planes, the disk elements 26 which are connected to one another on the outer diameter by means of the kneading bars 27. These kneading bars 27, but often also the disk elements 26, are arranged on helices for the purpose of more efficient transport of the product through the machine. If a longer retention-time range is desired for the process, individual kneading bars can also be arranged at an inclination for the purpose of return transport. The kneading elements arranged on the kneading shaft 29 mesh with the kneading bars 27 of this disk shaft. The kneading shaft 29 comprises a central tube 30, into which are inserted the shaft journals 31 and 32 supported in the bearings 9 and 11. The kneading elements 34 are arranged on the central tube 30, likewise usually on a helix, and are each composed of the radial parts 35 and 36 and of the kneading bar 37 connecting these two radial elements.

A level plate 21 which regulates the filling of the machine in the manner of an overflow weir is inserted between the housing part 3 and the outflow part 4.

The product fed to the kneading mixer in the connection 17 is picked up as a result of the inclination of the kneading bars 27, 37 on the two agitator shafts and is transported towards the outflow housing. After spilling over the level plate 21, the product falls into the outflow housing 4 and is discharged there through the connection 18.

Figure 3:
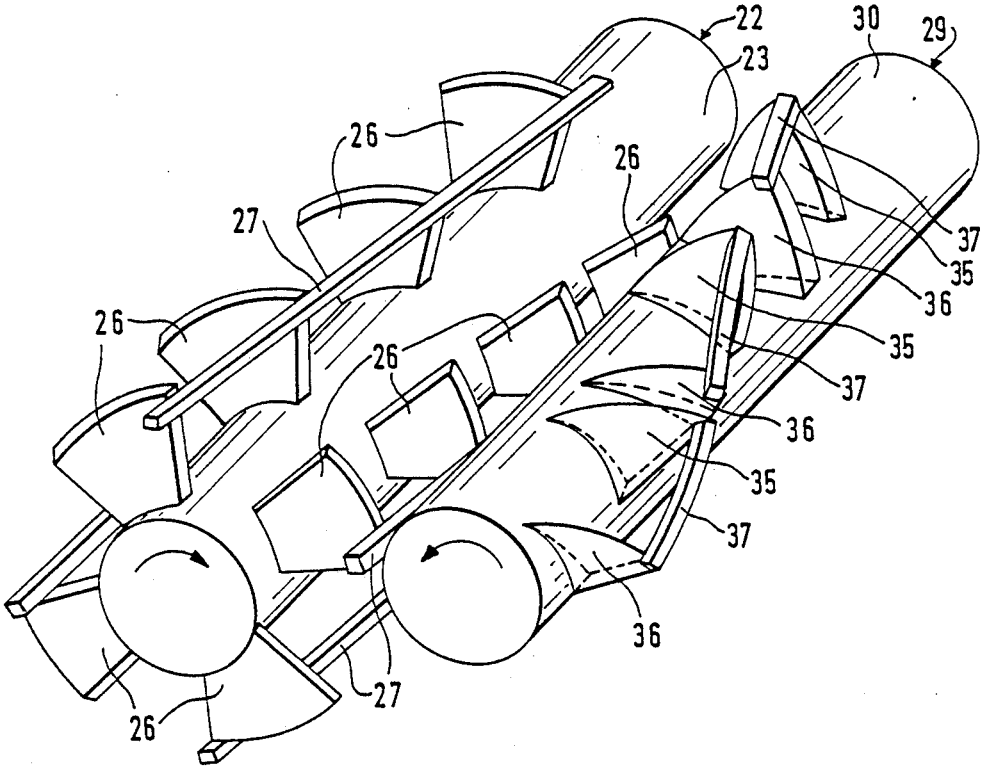
FIG. 3 shows a perspective representation of the working principle with kneading frames on the kneading shaft.

The cycle of movement can be seen in its simplest form in FIG. 3. During one revolution of the disk shaft 23, the kneading elements 34 of the kneading shaft 29 engage four times into the disk elements 26 of the disk shaft, the kneading bars 37 of the kneading shaft also meshing respectively with the kneading bars 27 of the disk shaft and thereby kneading the product intensively. At the same time, the usually heated surfaces of the disk elements and the agitator shaft 23 itself are cleaned. During this operation, the material is primarily moved radially between two opposing disk surfaces, but some of the product is always pressed against the disk elements as a result of positive displacement. This positive displacement of the product by kneading elements ensures excellent macro-mixing and kneading. However, according to the invention the actual micro-kneading for breaking down the agglomerates is intensified substantially as a result of the special form of the radial kneading-element parts 35 and 36 on the kneading shaft.

As shown in FIGS. 4 to 8, these radial kneading elements 35, 36 are designed so that, during the cycle of movement, the product is first scraped off from the disks 26 by means of the scraping edge 41, 45 and is guided and pressed into the kneading gap 43, 47 by the diverting surfaces 42, 46. Very high shearing forces occur in a known way in this confined space 43, 47 between a kneading element and the opposite disk and result in excellent microkneading and agglomerate breakdown. This cycle of movement also contributes essentially to the macro-mixing, since the product is moVed axially to and fro between the two opposite disk surfaces. The cycle of movement itself becomes clear from the longitudinal section according to FIG. 4 and from the associated cross-sections according to FIGS. 5, 6 and 7. In these cross-sections, the radial kneading elements 35 and 36 have the form of an involute arising from the kinematic development of the cycle of movement between the two agitator shafts.

The cross-sections of FIGS. 5, 6 and 7 illustrate a disk shaft, on which are arranged four disk elements 26, between which there are interspaces for the transport of the product. The disk elements are connected by means of the kneading bars 27 in front of a respective interspace. However, the kneading effect can be increased if only one interspace for each disk surface is provided for the transport of the product and if the other disk parts take the form of a solid surface. This results in a larger kneading surface for interaction between the radial kneading arms 35, 36 and the disks 26. This leads to an intensification of the kneading effect. It is further assisted because the kneaded product can escape to a lesser extent.

Figure 9:
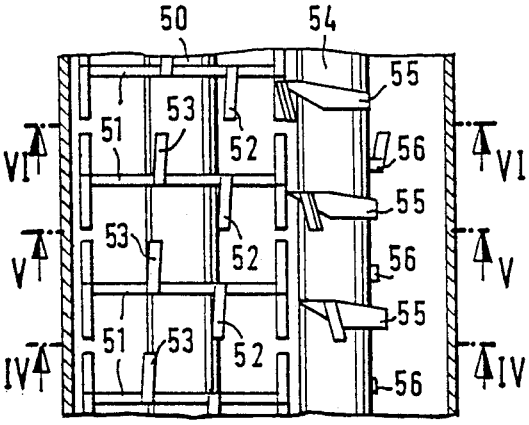
FIG. 9 shows a top view of an agitator portion, with the housing open at the top.

As already noted in relation to the reduction of the interspaces between the disks, the kneading intensity depends on the disk surface which is swept by the kneading elements of the kneading shaft. This disk surface can be further enlarged if, according to FIGS. 4 to 7, radial disk elements 60 are inserted as kneading counterelements in the interspaces between the rotating kneading elements 35, 36 in the housing of the kneading shaft. The top view in FIG. 9 of two agitator shafts in a partially cut away housing, the associated cross-sections according to FIGS. 10 to 12 and the developed view in FIG. 13 of the disk shaft, with the associated positions of the radial kneading elements of the kneading shaft, illustrate an even more effective application of the inventive principle. 50 denotes the disk shaft with the disk elements 51 and the kneading bars 52 and 53. 54 denotes the kneading shaft, on which the kneading elements 55 and 56 with the axial kneading bars 57 and 58 are fastened. The characteristic of this version is the axial kneading bars 52, 53 on the disk shaft and the axial kneading bars 57, 58 on the kneading shaft, which each extend only over approximately half the distance between the disk planes. Whereas, in the first-described version according to FIGS. 4 to 8, the arrangement of the two radial kneading elements between the disk surfaces is tied to the relatively flat helix of the kneading bar 27, the approximate half-length of the kneading bars on the two shafts allows an arrangement of the two radial kneading arms 55, 56 on the kneading shaft, in which a radial kneading gap for the free passage of the product is obtained between the diverting surface of each kneading arm and the opposite disk.

Figure 12:
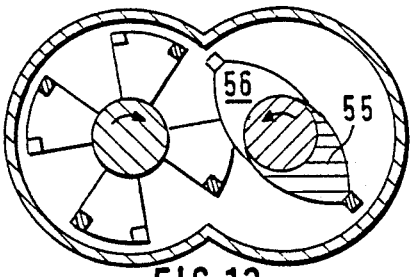
FIG. 12 shows a cross-section along the line VI—VI of FIG. 9.
Figure 11:
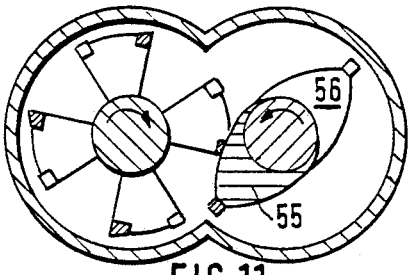
FIG. 11 shows a cross-section along the line V—V of FIG. 9.
Figure 10:
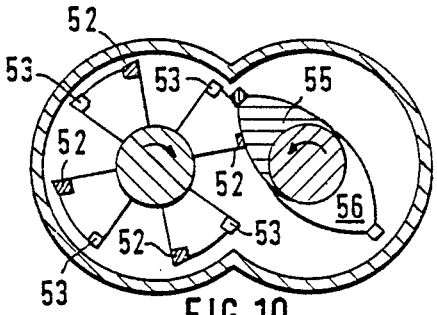
FIG. 10 shows a cross-section along the line IV—IV of FIG. 9.
Figure 13:
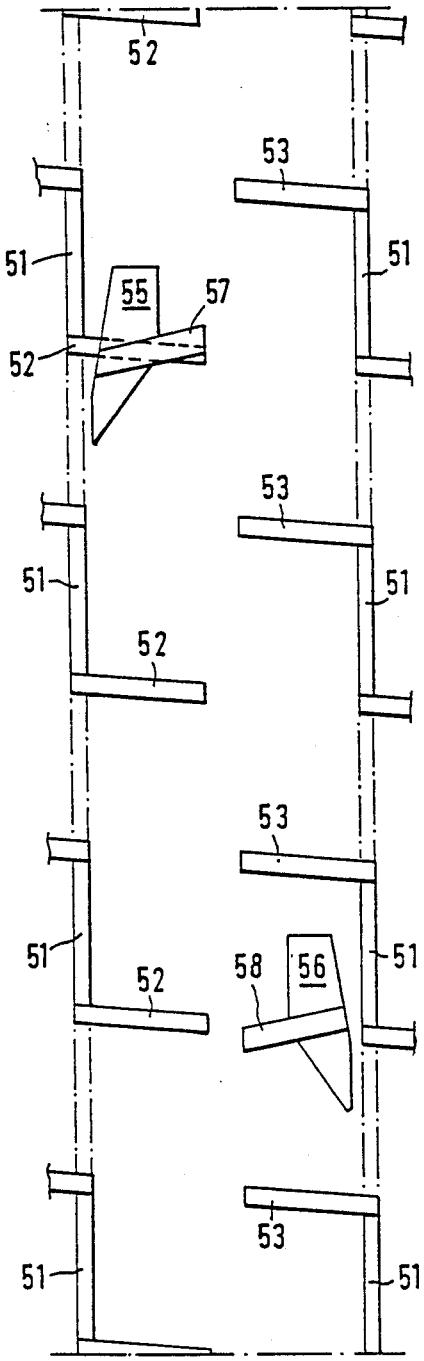
FIG. 13 shows a developed diagram to illustrate the functioning of the kneading elements with overhanging kneading bars.

As is evident from FIGS. 10 to 12, in the illustrated version the radial kneading elements of the kneading shaft are offset at 180 degrees. This makes it possible to narrow or widen the radial kneading gap, as desired, either by means of spacing of the disk surfaces or as a result of the axial extension of the kneading elements, in order to adapt the kneading effect as closely as possible to particular products. Furthermore, the free space for pushing the product to and fro between two disk planes and consequently also the macro-mixing are improved.

The axial direction of transport for the product can also be influenced if the length of the kneading bars is increased on one side and the opposite kneading bar is reduced correspondingly.

In the version of the kneading elements according to FIGS. 9 to 12, the axial kneading bars 57, 58 are attached to the radial kneading elements 55, 56. It is also possible, however, to form the kneading elements 55, 56 over the width of the kneading bars, so that a compact kneading tooth is obtained.

The mixing and kneading effect of the radial kneading elements can also be improved for many products if the scraping edges and the adjoining diverting surfaces for the product are divided so as to form two or more product streams which converge only again in the actual kneading gap and which are once more kneaded together there under the pressure of the shearing forces.

The subject of the invention and the arrangement of effective additional kneading gaps for a better microkneading of the product can be varied in many ways, either by changing the speed ratio between the two agitator shafts or by varying the disk surfaces, the number of radial kneading elements or the number of axial kneading bars. The working principle can likewise be varied if the two agitator shafts have either opposite or like directions of rotation.

All the machine surfaces coming in contact with the product are at least partially heatable or coolable according to a known system.

What is claimed is:

1. A multi-spindle kneading mixer for performing mechanical, chemical and/or thermal processes which comprises: at least two axis-parallel rotating shafts; disk elements on one of said shafts and an approximately axially aligned kneading bar on said disk elements; kneading elements on the second of said shafts, wherein the kneading elements on the second shaft and the kneading bars mesh, said kneading elements including a radial part; a scraping edge of the radial part of said kneading elements operative to scrape the disk elements; an inclined diverting surface of said kneading elements adjoining the scraping edge; and a kneading gap formed by the diverting surface and the disk elements; wherein the diverting surface is operative to divert the scraped-off product axially into said kneading gap.

2. A kneading mixer according to claim 1 wherein the kneading elements are in the form of a frame with a first and second radial part having an outer diameter, wherein a first radial part cleans one disk element and a second radial part cleans an opposite disk element, a second kneading bar connecting the two radial parts on their outer diameter and meshing with the axially aligned kneading bar on the disk elements, wherein the first radial part includes a first scraping edge and a first inclined diverting surface and the second radial pat includes a second scraping edge and a second inclined diverting surface.

3. A kneading mixer according to claim 1 wherein the kneading elements on the second shaft are made tooth-like from solid material.

4. A kneading mixer according to claim 1 wherein the diverting surfaces behind the scraping edges of the kneading elements divide the product into several product streams of differing direction which flow together again after the division.

5. A kneading mixer according to claim 1 wherein, in order to prevent dead spaces, the kneading elements on the second shaft are designed, in the radial plane, in an involute form which corresponds geometrically to the cycle of movement between the two shafts.

6. A kneading mixer according to claim 1 including a housing of the second shaft, wherein the disk elements are fastened in the housing of the second shaft between the radial parts.

7. A kneading mixer according to claim 1 wherein the machine surfaces coming in contact with the product are at least partially heatable or coolable.

8. A multi-spindle kneading mixer for performing mechanical, chemical and/or thermal processes which comprises: at least two axis-parallel rotating shafts; disk elements on one of said shafts and an approximately axially aligned kneading bar on said disk elements; kneading elements on the second of said shafts, wherein the kneading elements on the second shaft and the kneading bars mesh, said kneading elements including a radial part; a scraping edge of the radial part of said kneading elements operative to scrape the disk elements; an inclined diverting surface of said kneading elements adjoining the scraping edge; and a kneading gap formed by the diverting surface and the disk elements; wherein the diverting surface is operative to divert the scraped-off product axially into said kneading gap, said radial parts including a first and second radial part with each radial part including a respective first and second axial kneading bar, wherein the first radial part and first kneading bar sweep over some of the space between the disk elements and wherein the second radial part and second kneading bar sweep over the remaining space between the disk elements.

* * * * *